US008752518B2

(12) United States Patent
Boegershausen et al.

(10) Patent No.: US 8,752,518 B2
(45) Date of Patent: Jun. 17, 2014

(54) SWITCHABLE PRESSURE SUPPLY DEVICE

(75) Inventors: Mathias Boegershausen, Puschendorf (DE); Michael Busse, Herzogenaurach (DE); Eduard Golovatai-Schmidt, Hemhofen (DE); Andreas Strauss, Forchheim (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 56 days.

(21) Appl. No.: 13/510,395

(22) PCT Filed: Nov. 17, 2010

(86) PCT No.: PCT/EP2010/067662

§ 371 (c)(1), (2), (4) Date: May 17, 2012

(87) PCT Pub. No.: WO2011/061219

PCT Pub. Date: May 26, 2011

(65) Prior Publication Data

US 2012/0227691 A1 Sep. 13, 2012

(30) Foreign Application Priority Data

Nov. 20, 2009 (DE) ..... 10 2009 054 052

(51) Int. Cl.
*F01M 1/06* (2006.01)
*F01L 1/344* (2006.01)

(52) U.S. Cl.
CPC ..... *F01L 1/344* (2013.01)
USPC ..... 123/90.34; 123/90.17

(58) Field of Classification Search
CPC ..... F01L 2001/34446; F01L 1/047; F01L 2001/0473; F01L 2001/0475; F01L 2001/0471; F01L 1/344; F01L 1/3442; F15B 2201/21; F15B 1/04
USPC ..... 123/90.15, 90.17
See application file for complete search history.

(56) References Cited

U.S. PATENT DOCUMENTS 8,485,152 B2 * 7/2013 Boegershausen et al. . 123/90.34
2003/0188705 A1 10/2003 Aimone (Continued)

FOREIGN PATENT DOCUMENTS

DE 19908934 9/2000
DE 19616973 11/2003

(Continued)

*Primary Examiner* — Thomas Denion
*Assistant Examiner* — Daniel Bernstein
(74) *Attorney, Agent, or Firm* — Volpe and Koenig, P.C.

(57) ABSTRACT

A switchable device for supplying at least one consumer of an internal combustion engine with pressure. The device includes the following: a cavity formed inside a camshaft; a displacement element arranged in the cavity, which element can be displaced between a first end position and a second end position, the displacement element having a pressure surface which at least partially delimits a fluid connectible accumulator chamber together with the wall of the cavity, the accumulator chamber being connectible to a pressure source in a fluid-conducting manner; an energy accumulator interacts with the displacement element, the displacement element being displaceable against the force of the energy accumulator from the first end position into the second end position under the effect of pressure applied to the accumulator chamber; a locking mechanism by which the displacement element can be locked in the second end position; a switching mechanism which can be actuated by an actuator, has a switch element that can be brought into at least two switching positions and interacts with the locking mechanism in such a manner that the locked state of the displacement element is maintained in a first switching position and is released in a second switching position.

12 Claims, 4 Drawing Sheets

(56) References Cited

U.S. PATENT DOCUMENTS

| | | | | |
|---|---|---|---|---|
| 2005/0072397 | A1 | 4/2005 | Sluka et al. | |
| 2012/0304953 | A1 * | 12/2012 | Boegershausen | 123/188.4 |

FOREIGN PATENT DOCUMENTS

| | | |
|---|---|---|
| DE | 19727180 | 12/2003 |
| DE | 10228354 | 1/2004 |
| DE | 10239207 | 3/2004 |
| DE | 202005008264 | 9/2005 |
| DE | 102005013141 | 9/2006 |
| DE | 102006014756 | 10/2007 |
| DE | 102007056684 | 5/2009 |
| EP | 1197641 | 4/2002 |
| EP | 1243761 | 9/2002 |
| EP | 1353075 | 10/2003 |
| EP | 1596040 | 11/2005 |
| EP | 1596041 | 11/2005 |
| GB | 1357236 | 6/1974 |
| WO | 2006039966 | 4/2006 |
| WO | 2008140897 | 11/2008 |

* cited by examiner

SWITCHABLE PRESSURE SUPPLY DEVICE

FIELD OF THE INVENTION

The invention lies in the technical field of internal combustion engines and relates to a switchable device integrated in a cavity of a camshaft for a pressure supply to loads of an internal combustion engine.

BACKGROUND

From Patent No. EP 1197641 A2, a pressure accumulator for supporting a hydraulically adjustable camshaft is known in which the flow of hydraulic fluid into or out of the pressure accumulator is controlled by the use of different solenoid valves.

A pressure accumulator with a separate housing is further known from the German Laid Open Patent Application DE 102007056684 A1 of the applicant.

SUMMARY

Accordingly, the objective of the present invention relates to refining conventional pressure accumulators for supplying pressure to loads in internal combustion engines in an advantageous manner.

This and other objects are met according to the proposal of the invention by a switchable device for supplying pressure with the features of the main claim. Advantageous constructions of the invention are specified by the features of the subordinate claims.

According to the invention, a switchable device for a pressure supply (switchable pressure accumulator) to at least one load of an internal combustion engine is shown. The load can involve, in particular, a hydraulic camshaft adjuster for adjusting the phase position between the crankshaft and camshaft. It is also conceivable, however, that the device is used, for example, in an electrohydraulic valve actuation device of an internal combustion engine.

The device for supplying pressure comprises a cavity formed within a camshaft of the internal combustion engine and a displacement element that is arranged in the cavity and can be displaced between a first end position and a second end position. The displacement element has a pressure surface that at least partially bounds, together with a wall of the cavity, a storage space that can be connected or is connected in a fluid-conducting manner to the load. The storage space can be connected or is connected to a pressure source or pressurized medium source in a fluid-conducting manner. For example, the storage space is connected to the lubricating oil circuit of the internal combustion engine, wherein an oil pump is used as the pressure source and oil of the lubricating oil circuit is used as the pressurized medium. The displacement element can be constructed, for example, in the form of a piston with an end-side pressure surface.

The device according to the invention further comprises a force accumulator that interacts with the displacement element so that the displacement element can be displaced by pressurization of the storage space against the force of the force accumulator from the first end position into the second end position. The force accumulator is constructed, for example, as a spring element, in particular, in the form of a compression spring, wherein any other suitable spring type could also be used.

The device according to the invention further comprises a locking mechanism through which the displacement element can be locked detachably in the second end position in which the force accumulator is clamped.

In addition, the device according to the invention comprises a switching mechanism with a switch element, wherein this switching mechanism is actuated by an actuator and can be brought into at least two switch positions, wherein the switch element interacts with the locking mechanism so that the locking of the displacement element is maintained in a first switch position and is released in a second switch position. Advantageously, the switching element can be displaced between the two switch positions by an actuator rotationally decoupled from the camshaft.

For relatively low installation space requirements, the device according to the invention allows a more reliable and more secure supply of pressure to the loads of an internal combustion engine that is provided independent of the pressure in the lubricating circuit of the internal combustion engine.

In one advantageous construction of the device according to the invention, the storage space can be connected or is connected in a fluid-conducting manner to the pressure source and to the load with at least one leakage prevention device provided in-between. The leakage prevention device is constructed so that it allows the through flow of pressurized medium, while it blocks the through flow of non-pressurized medium merely at the hydrostatic pressure. Thus, the leakage prevention device can prevent leakage from the storage space if insufficient pressure is supplied by the pressure source, for example, in the case of insufficient output from the oil pump. The leakage prevention device can be used as a limit for the storage space and can form, in particular, a stop for the locking element in the second switch position.

In another advantageous construction of the device according to the invention, it comprises a ball carrier that is connected rigidly to the camshaft and surrounds the switch element. The ball carrier has a plurality of openings in each of which a ball is held so that it can move freely in the radial direction. Here, the balls are supported in the radial direction by a support surface formed by the switch element.

In this construction of the device, the device further comprises a locking element that is connected rigidly to the displacement element and is provided with a locking section that is led into engagement with the balls in the second end position of the displacement element, for example, in that it engages behind these balls, in order to lock the displacement element on the camshaft. On the other side, the locking element is not led into engagement with the balls in the first end position of the displacement body, so that the displacement element is not locked.

In this construction of the device, a first non-return element is also provided that is arranged so that the switch element can be displaced by the actuator relative to the ball carrier against the force of the first non-return element from the first switch position into the second switch position. The first non-return element is constructed, for example, as a spring element, in particular, in the form of a compression spring, wherein any other suitable spring type could also be used.

In this construction of the device, the support surface of the switch element is provided with at least one recess that is allocated to the balls and is constructed and arranged so that the balls can be held at least partially in the recess in the second switch position of the switch element, so that the locking section is led out of engagement with the balls and the locking of the displacement element is released. On the other side, the balls are not held by the recess of the support surface in the first switch position of the switch element, so that the locking of the displacement element is maintained.

These measures allow a technically especially simple realization of the locking and switch mechanism, wherein the device for supplying pressure is distinguished by an especially good response behavior.

In the above construction of the invention, it can also be advantageous if a sliding element is provided that can be displaced by the displacement element against the force of a second restoring element, wherein the sliding element is constructed so that it slides around the balls for securing them in their radial position in the first end position of the displacement element and releases these balls in the second end position. Thus the sliding element forms a captive securing device for the balls when these are not in engagement with the locking section of the locking element. The second restoring element is constructed, for example, as a spring element, in particular, in the form of a compression spring, wherein any other suitable type of spring could also be used.

In another advantageous construction of the device according to the invention for supplying pressure, this is provided with a sealing element that seals the camshaft to the outside and on which the force accumulator of the displacement element is supported. The sealing element can be used here especially for securing the position of the force accumulator.

In another advantageous construction of the device according to the invention, the pressure source can be connected or is connected in a fluid-conducting manner via a non-return valve that forms a block in the direction toward the pressure source to the load and to the storage space.

The invention further extends to an internal combustion engine that is equipped with at least one device that can be switched as described above for supplying pressure to at least one load.

BRIEF DESCRIPTION OF THE DRAWINGS

The invention will now be explained in more detail with reference to an embodiment, wherein reference is made to the accompanying drawings. Elements that are identical or have identical actions are designated in the drawings with the same reference symbols. Shown are.

DETAILED DESCRIPTION OF THE PREFERRED EMBODIMENTS

Figure 1:
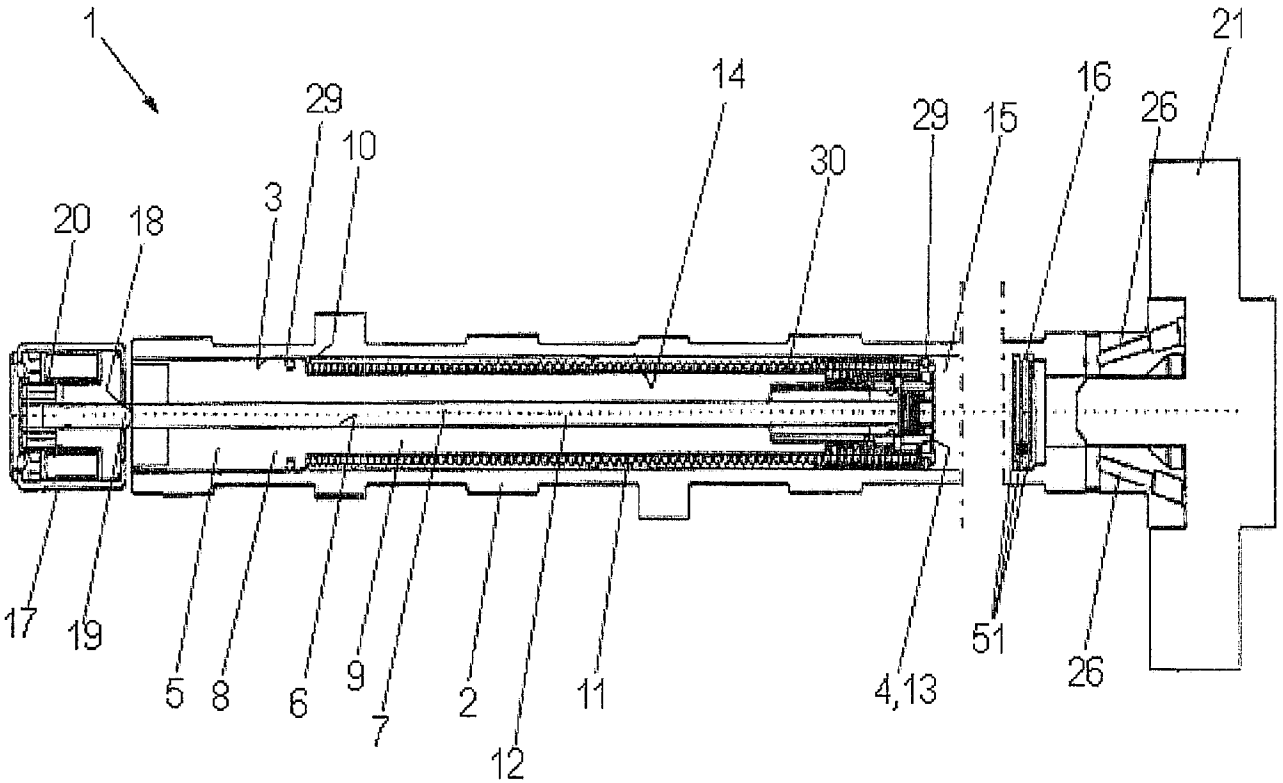
FIG. 1 is a schematic axial section diagram of an embodiment of the device according to the invention for supplying pressure.
Figure 2:
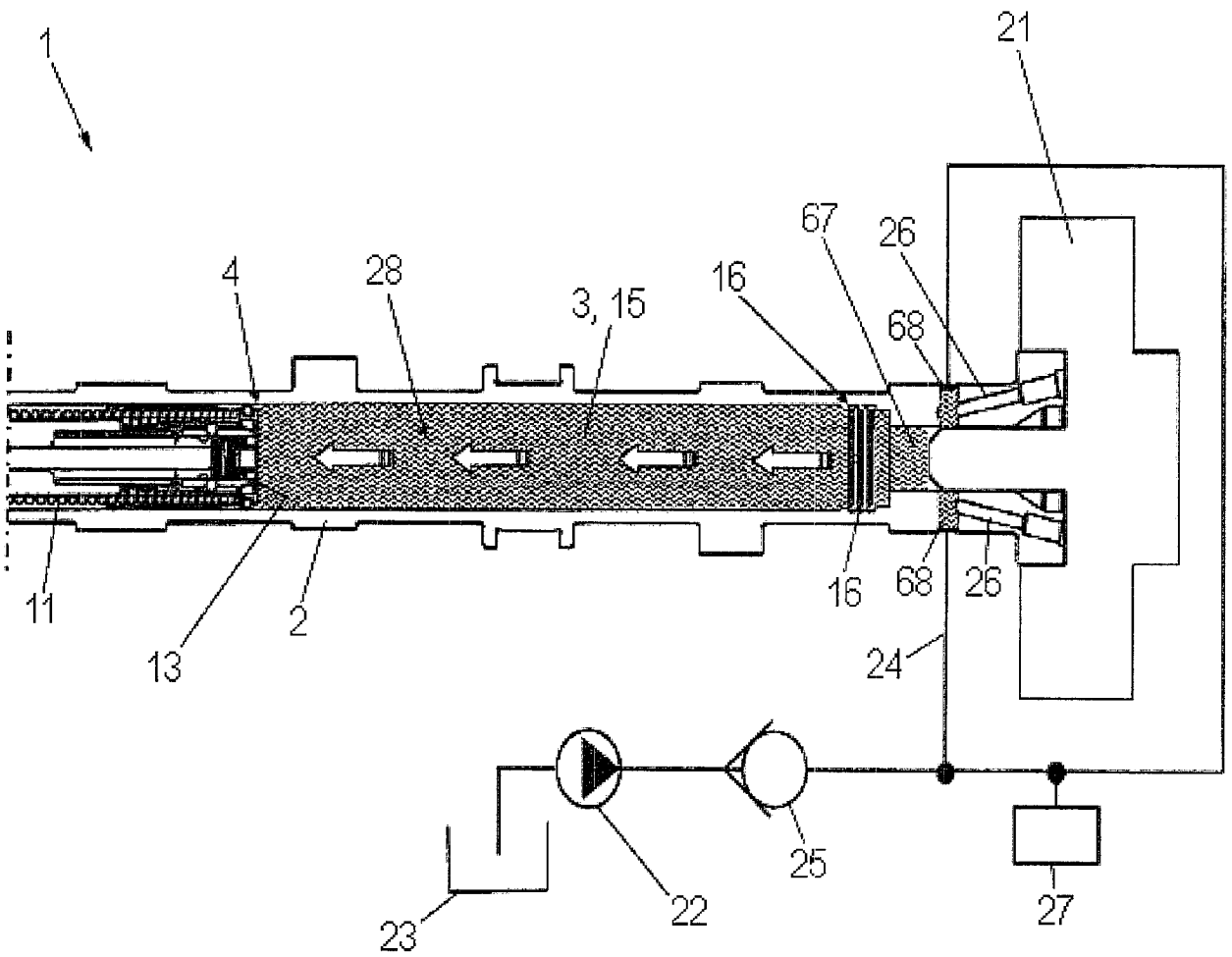
FIG. 2 is a schematic overview diagram, with reference to which the connection of the device for supplying pressure from FIG. 1 to the lubricating oil circuit of an internal combustion engine is illustrated.

FIG. 1 and FIG. 2 will be considered first, wherein an embodiment of the device according to the invention for a pressure supply for loads of an internal combustion engine, as well as the connection of the device to the lubricating oil circuit of an internal combustion engine, are shown. The device designated overall with the reference number 1 comprises a hollow space 3 that is shaped within a camshaft 2 and in which a displacement element constructed in the shape of a hollow piston 4 is held. The built-up camshaft 2 as an example here can be rotated about a central rotational axis 7. The same would also be conceivable, however, if the camshaft 2 was produced in the foundry process.

Into the hollow space 3 of the camshaft 2, a sealing body 5 is pressed that is constructed in the shape of a stepped cylinder and extends from one end of the camshaft 2 into the hollow space 3. It can be divided into a terminal first section 8 with larger diameter and an adjacent second section 9 with smaller diameter, wherein a ring stage 10 of the sealing body 5 is produced. A force accumulator spring (helical compression spring) 11 used as a force accumulator is supported with one of its ends on the ring stage 10 of the sealing body 5. With its other end, this force accumulator contacts the piston 4.

The sealing body 5 connected rigidly to the camshaft 2 is provided with a central axial bore 6 in which a switch rod 12 is held so that it can be displaced in the axial direction. The switch rod 12 can be actuated by an electromagnetic actuator 17 that is arranged on one end of the camshaft 2, wherein a tappet 19 engages an end-side contact surface 18 of the switch rod 12 for this purpose. The switch rod 12 is part of a switch mechanism for releasing a locking mechanism for the piston 4 that will be explained in more detail farther below in connection with FIG. 3 and FIG. 4.

The piston 4 has an end-side pressure surface 13 that defines a storage space 15 for compressed oil 28 together with an inner wall 14 of the hollow space 3 of the camshaft 2 and a leakage prevention device 16.

Opposite the actuator 17, a hydraulic camshaft adjuster 21 is attached, for example, by a (not shown) central screw to the end side of the camshaft 2. As usual, the hydraulic camshaft adjuster 21 comprises a drive part in drive connection with the crankshaft via a drive wheel and a camshaft-fixed driven part, as well as a hydraulic actuating drive that is switched between a drive part and a driven part and transfers the torque from the drive part to the driven part and allows an adjustment and fixing of the rotational position between these parts. The hydraulic actuating drive is provided with at least one pressure chamber pair that act against each other and can be selectively pressurized with pressurized oil, in order to generate a change in the rotational position between the drive part and driven part by generating a pressure drop across the two pressure chambers. Hydraulic camshaft adjusters as such are well known to someone skilled in the art and described in detail, for example, in publications DE 202005008264 U1, EP 1596040 A2, DE 102005013141 A1, DE 19908934 A1, and WO 2006/039966 of the applicant, so that more exact details do not need to be discussed here.

As can be taken from FIG. 2, the hydraulic camshaft adjuster 21 and the storage space 15 are connected in a fluid-conducting manner via a common pressure line 24 with a pressure source or pressurized medium source constructed in the form of an oil pump 22. The oil pump 22 can feed pressurized oil 28 from an oil tank 23 to the camshaft adjuster 21 and storage space 15. A non-return valve 25 that is arranged in the pressure line 24 and forms a block in the direction toward the oil pump 22 prevents a return flow of pressurized oil in the case of reduced or insufficient output from the oil pump 22.

In the central screw for fastening the camshaft adjuster 21 to the camshaft 2, a control valve not shown in more detail is arranged for controlling the oil flows. This control valve can connect the pressure chambers of the camshaft adjuster 21 in a fluid-conducting manner via oil paths 26 selectively with the oil pump 22 or via a (not shown) oil line with the oil tank 23. Such control valves are well known as such to someone skilled in the art and described in detail, for example, in the German Patent DE 19727180 C2, the German Patent DE 19616973 C2, the European Patent Application EP 1 596 041 A2, and the German Laid Open Patent Application DE 102 39 207 A1 of the applicant, so that more exact details do not have to be discussed here.

The storage space 15 is connected in a fluid-conducting manner via a connection space 67 to the control valve of the camshaft adjuster 21. The oil paths 26 are connected in a fluid-conducting manner via corresponding pressure channels 68 to the pressure line 24.

In the internal combustion engine, additional loads 27 are connected to the lubricating oil circuit, such as support elements and a camshaft bearing that must be supplied with pressurized oil 28.

The piston 4 can be pushed against the spring force of the force accumulator spring 11 by pressurization of the storage space 15, as shown in FIG. 2 by the arrows. Here, pressurized oil 28 is fed by the oil pump 22 via the pressure line 24 into the storage space 15, wherein the pressurized oil 28 passes through the leakage prevention device 16 that is transmissible for pressurized oil 28. Here, the piston 4 is pushed from a first end position into a second end position in which the force accumulator spring 11 is tensioned or is more strongly tensioned in the event of a biasing tension. Through a plurality of ring seals 29, the storage space 15 is sealed oil-tight from the outside.

In the second end position, the piston 4 can be locked by a locking mechanism. The locking mechanism will now be explained in more detail with reference to FIG. 3, which is an enlarged axial section view of the device 1 with locked piston 4. The locking mechanism thus comprises a sleeve-shaped ball carrier 31 that is pressed into a sleeve-shaped end section 30 of the sealing body 5 and has a plurality of radial bores 32 arranged distributed in the peripheral direction. A ball 33 is held in each of these bores. Here, the bores 32 each have a larger diameter than the balls 33, so that these are freely moveable in the radial direction in the bores 32. The ball carrier 31 is provided with an end surface 58 on its side facing away from the sealing body 5.

Furthermore, a sleeve body 36 is pressed into a hollow space 35 of the ball carrier 31, wherein this sleeve body contacts a shoulder 39 of the sealing body 5 with a first end surface 59 facing away from the piston 4, and wherein oil tightness is ensured by an intermediary ring seal 29. An opposite second end surface 60 of the sleeve body 36 forms an end stop for a switch pin 37 connected rigidly to the switch rod 12.

An outer lateral surface 41 of the switch pin 37 is provided with a ring groove 38 whose axial section has a ball-shell shape and is allocated to the balls 33. On its end facing away from the sleeve body 36, the switch pin 37 is provided with a sleeve-shaped end section 42 in which a restoring spring 43 is held. The restoring spring 43 is supported with its one end on a ring stage 46 shaped by the switch pin 37 and is supported with its other end on a plunger 44. In the locking position of the piston 4 shown in FIG. 3, the plunger 44 contacts an inner surface 34 of the piston 4. The plunger 44 is secured by a snap ring 45 against falling out from the end section 42 of the switch pin 37.

Furthermore, on an outer lateral surface 40 of the ball carrier 31, an at least approximately sleeve-shaped sliding body 47 is arranged so that it can move in the axial direction relative to the ball carrier 31. The sliding body 47 is loaded by a sliding spring 49 that is constructed here, for example, as a compression spring. For this purpose, the sliding spring 49 is supported with one end on an end surface 62 of the sealing body 5 and with its other end on a ring stage 48 of the sliding body 47, so that the sliding body 47 is loaded by the spring force of the sliding spring 49 in the direction of the switch pin 37. The sliding body 47 made, for example, from sheet steel is provided with a sliding section 50 that slides into the locking position shown in FIG. 3 over the balls 33 and thus acts as a captive securing device. In the non-locked position of the piston 4 shown in FIG. 4, the sliding section 50 releases the balls 33.

The piston 4 is connected to a sleeve-shaped locking body 53. The locking body 53 is provided with a radially projecting collar 54 that is provided for this purpose and is pressed by the force accumulator 11 against a shoulder 52 of the piston 4, so that the locking body 53 is connected by a non-positive fit to the piston 4. The locking body 53 has a locking section 55 with a radially inward directed ring bead 56 that forms a recess 57.

Figure 3:
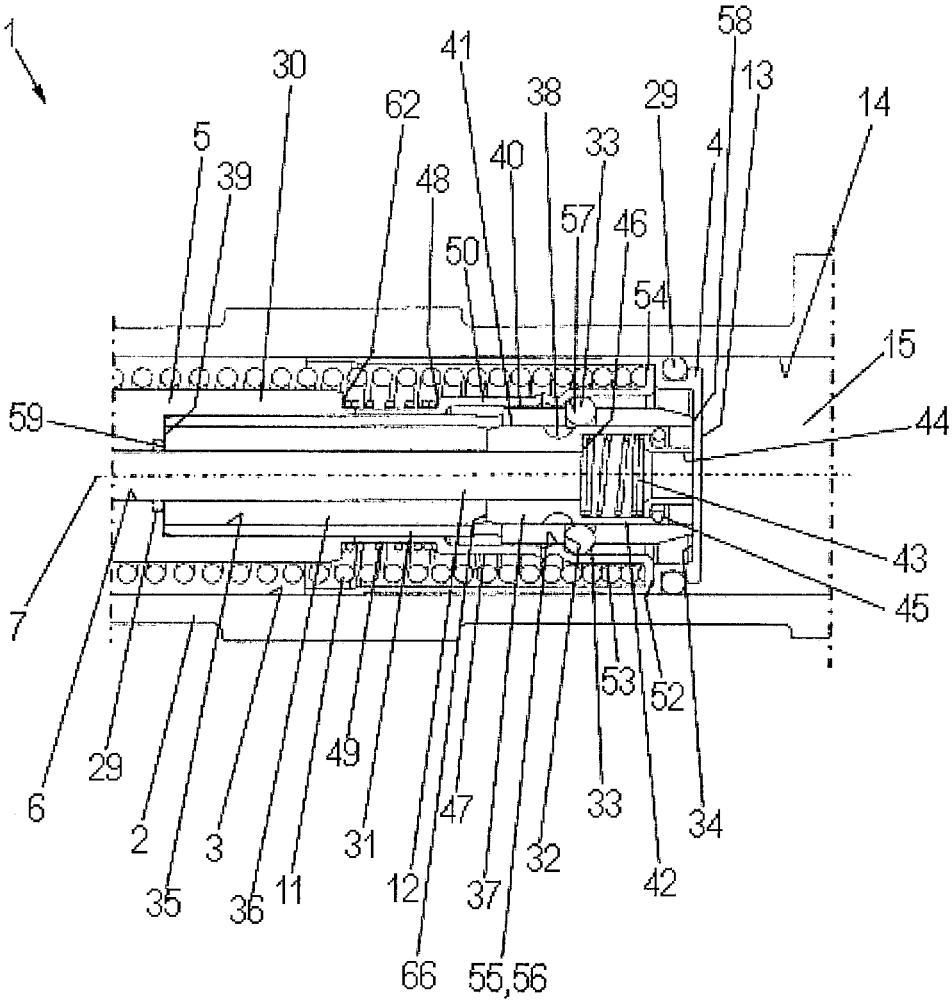
FIG. 3 is an enlarged section from FIG. 1 with locked switching element of the device for supplying pressure.

Now if the storage space 15 is loaded with pressurized oil starting from the non-locked position shown in FIG. 1, the piston 4 is displaced by its pressure surface 13 against the spring force of the force accumulator 11. Here, an end surface 61 of the locking body 53 comes into contact with a first end surface 63 of the sliding body 47 and displaces this body against the spring force of the sliding spring 49 up to the balls 33 in the region of the recess 57. In addition, the inner surface 34 comes into contact with an end surface 65 of the plunger 44, wherein the switch pin 37 is displaced in the same direction as the piston 4 loaded by the restoring spring 43. Here, the balls 33 are pressed out from the ring groove 38 of the switch pin 37 into the recess 57. This movement of the balls 33 is supported by centrifugal force of the rotating camshaft 2. The balls 33 then contact the outer lateral surface 41 of the switch pin 37, wherein the ring bead 56 engages behind the balls 33. An end surface 66 of the switch pin 37 facing away from the plunger 44 is here led into contact with the second end surface 60 of the sleeve body 36 that thus acts as a stop for the switch pin 37. By means of the switch pin 37, the switch rod 12 is displaced in the central axial bore 6 of the sealing piece 5. Finally, the inner surface 34 of the piston 4 is led into contact with the end surface 58 of the ball carrier 31 that thus acts as a stop for the piston 4. The locked end position of the piston 4 reached in this way is shown in FIG. 3 (called a second end position in the introduction to the description). The storage space 15 has a maximum volume, i.e., is filled to a maximum degree with pressurized oil 28 in the second end position of the piston 4.

Figure 4:
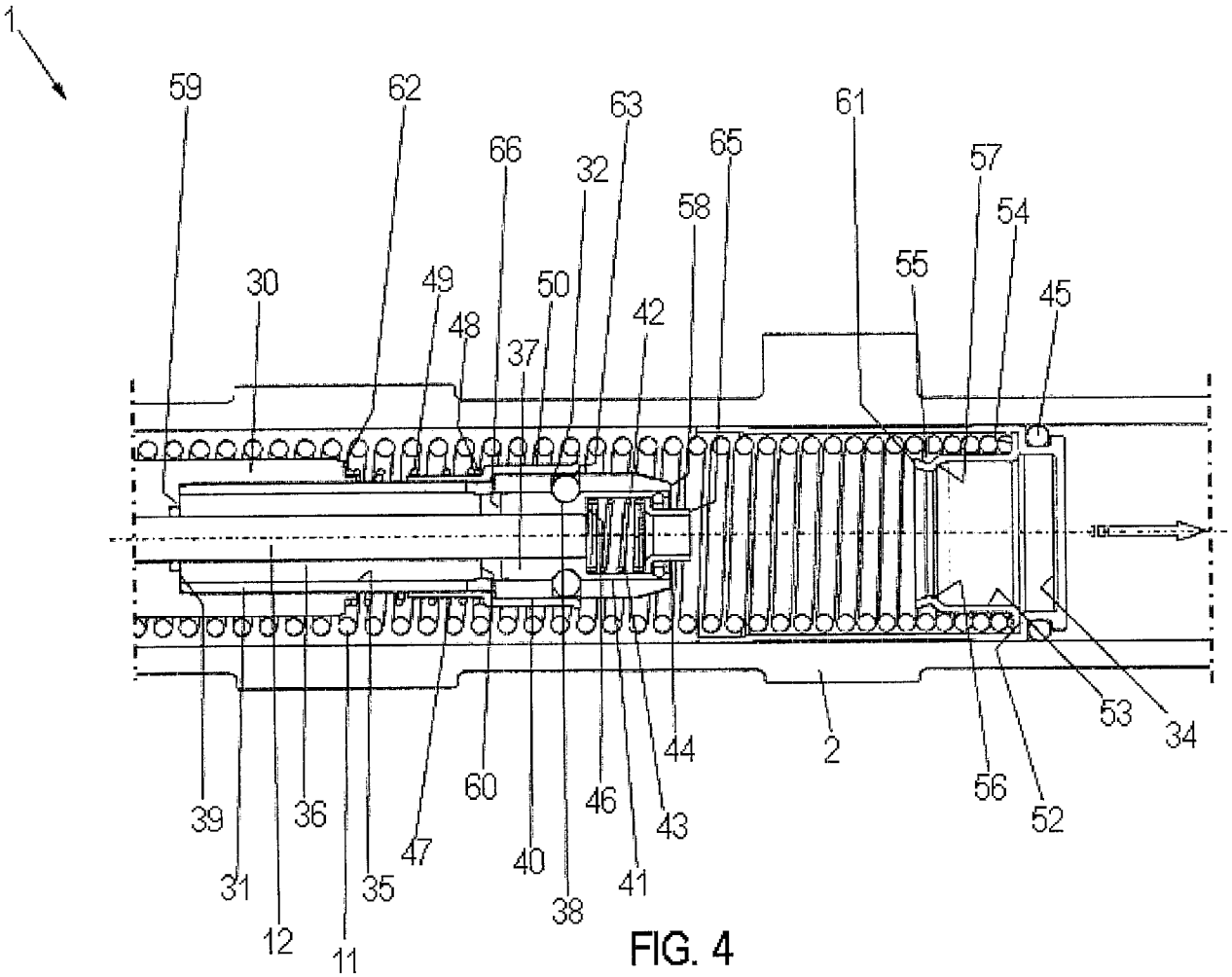
FIG. 4 is an enlarged section from FIG. 1 with released switching element of the device for supplying pressure.

Through a switching mechanism to be explained below, the locked piston 4 can be released. In FIG. 4, an unlocked position of the piston 4 is shown. For this purpose, the switch rod 12 can be moved by the tappet 19 contacting the contact surface 18 against the force of the restoring spring 43. Here, the tappet 19 acts on the end contact surface 18 of the switch rod 12, wherein the tappet 19 is attached rigidly to a magnetic armature of an electromagnet 20 of the actuator 17 and can be displaced in the axial direction by energizing the magnetic armature. If the magnetic armature is not energized, the switch rod 12 is restored by the spring force of the restoring spring 43. For releasing the lock, the switch rod 12 and the switch pin 37 that contacts the switch rod 12 is displaced by the action of the tappet 19 until the ring groove is aligned with the bores 32 of the ball carrier 31. This has the result that the balls 33 enter into the ring groove 38, so that the ring bead 56 no longer engages behind the balls 33 or the balls 33 come out from the recess 57. The locking section 53 of the locking element 53 thus loses its engagement with the balls 33, wherein the locking of the piston 4 is released.

As shown in FIG. 4 by the arrow, the piston 4 is then displaced by the spring force of the force accumulator spring 11, so that the volume of the storage space 15 is reduced and the pressurized oil 28 contained therein is discharged to the camshaft adjuster 2 and the other loads 27. The non-return valve 25 prevents pressurized oil 28 from reaching the oil pump 22. Simultaneously, the sliding body 47 is displaced by the spring force of the sliding spring 49, wherein the sliding section 50 slides over the balls 33. When the piston 4 is displaced by the force accumulator spring 11, the leakage prevention device 16 forms a stop for the piston 4. (The end position reached in this way is designated the first end position in the introduction to the description.) The pressurized oil 28 pressurized by the piston 4 can pass the leakage prevention device 16. The leakage prevention device 16 comprises, for example, three disks that are locked in rotation with each other and are each provided with a bore, wherein the three bores are each offset by 120° relative to each other. This measure allows pressurized oil 28 to pass the leakage prevention device 16 and blocks the passage of pressurized oil 28 at merely atmospheric or hydrostatic pressure.

Additional features of the invention are given from the following description:

In the device according to the invention, a piston integrated in the camshaft is biased by the pressure of the oil pump when the internal combustion engine is running against a spring element up to a defined stroke. In this position, the piston engages in a holding mechanism (ball lock). When the internal combustion engine is turned off, the oil pressure in the oil galleries drops to ambient pressure, just like the pressure in the pressure accumulator. The energy remains stored in the spring element. Through a leakage prevention device (e.g., plate-labyrinth securing device), the lubricating oil cannot return from the oil storage space back into the oil galleries or via the camshaft bearing points into the cylinder head. This pressure accumulator has no pressure loss due to leakage. Complicated high-pressure seals are eliminated. In this way, the system friction is reduced and more usable energy is stored in the spring element. A radially decoupled actuator that is mounted outside the camshaft can release the holding mechanism through brief actuation. By means of the biased spring, the oil is forced from the oil storage space back into the oil circuit of the cylinder head and the camshaft adjuster, assuming that the supply oil pressure in the oil galleries is less than the pressure that can be reached with the pressure accumulator (spring element force multiplied with the piston pressure surface). To prevent a return flow of the oil in the direction of the oil pump when discharging, a non-return valve that forms a block in the direction of the oil pump is provided between the oil pump and the loads to be pressurized with the oil pressure from the pressure accumulator.

In the device according to the invention, the piston is guided in the axial direction in the camshaft and supported by a spring element (e.g., tensile or compression spring) on the sealing body that is pressed into the camshaft. The locking body is pressed into the piston. In the sealing body, the ball carrier is pressed. This has eight radial bores that are arranged distributed, for example, around the periphery and into which balls are guided. The sleeve pressed into the ball carrier is used as an end stop for the switch pin. The restoring spring of the switch pin is supported on the piston by means of the plunger and presses the switch pin against the sleeve. The plunger is secured against falling out by a snap ring. The switch rod is connected rigidly to the switch pin and is supported so that it can be displaced in the axial direction in the sealing body. The actuator is screwed into the cylinder head and presses on the switch rod against the restoring spring in the energized state. The attachment to the switch rod/camshaft is realized by a radial decoupling device. The sliding spring biases the axially displaceable sliding plate. A plate-labyrinth leakage prevention device formed of three plates each with a bore in the axial direction on the outer diameter is used, for example, as the leakage prevention device of the cylinder for "pressure-free" oil. The plates are rotated relative to each other by 120°. An advantage in terms of installation space is produced by the arrangement in the hollow space of the camshaft in comparison with pressure accumulators arranged outside of the camshaft.

The filling/locking process: when the internal combustion engine is running, oil flows via the camshaft bearing point into the camshaft in the direction of the camshaft adjuster and through the labyrinth-plate leakage prevention device against the piston of the pressure accumulator. Starting at a limit pressure that is given by the force of the force accumulator spring, the piston moves against the spring force in the direction of the locking mechanism. The locking body pushes the sliding plate against the sliding spring in the direction of the sealing body. At the same time, the piston presses against the switch pin via the plunger and the restoring spring. As soon as the contours of the locking body releases the bores in the ball carrier, the balls are pressed outward and thus the piston is locked rigidly. The movement of the balls is supported by centrifugal force generated by the rotating camshaft. Then the switch pin is pressed by the restoring spring against the sleeve and therefore the balls are held in the current position.

The unloading/unlocking process: when the actuator is energized, the switch rod and the switch pin are displaced against the restoring spring in the direction of the piston. As soon as the groove in the switch pin is over the radial bores in the ball carrier, the force accumulator spring presses the balls inward by means of the contours in the locking element against the switch pin until the cross section is free. The piston is now pressed forward, wherein the oil is pressed from the storage space into the oil galleries and in parallel into the control valve of the camshaft adjuster. A non-return valve in the oil supply gallery prevents oil from flowing back from the cylinder head. The plate-labyrinth leakage prevention device simultaneously acts as an end stop for the piston.

The device according to the invention thus allows a reliable supply of pressure to loads of an internal combustion engine, wherein, through the pressure accumulator integrated in the camshaft, pressurized oil is made available independent of the engine oil supply (lubricating oil circuit) of the internal combustion engine. Thus, loads can also be supplied with pressurized oil when the engine-side oil supply is not adequate, for example, when the engine is started and in the case of very hot pressurized oil in connection with a low output of the oil pump. In particular, immediately after the internal combustion engine is started, the camshaft adjuster can be adjusted into a base position (retarded, middle, advanced position), which is especially suitable in connection with start/stop systems. In addition, the adjustment rate of the camshaft adjuster can be improved, especially for the case of hot idling of the internal combustion engine.

LIST OF REFERENCE SYMBOLS

1 Device
2 Camshaft
3 Cavity of the camshaft
4 Piston
5 Sealing body
6 Axial bore
7 Rotational axis
8 First section
9 Second section
10 Ring step of the sealing body
11 Force accumulator spring
12 Switching rod
13 Pressure surface
14 Wall

15 Storage room
16 Leakage prevention device
17 Actuator
18 Contact surface
19 Tappet
20 Electromagnet
21 Camshaft adjuster
22 Oil pump
23 Oil tank
24 Pressure line
25 Non-return valve
26 Oil path
27 Load
28 Pressurized oil
29 Ring seal
30 End section of the sealing body
31 Ball carrier
32 Bore
33 Ball
34 Inner surface
35 Cavity of the ball carrier
36 Sleeve body
37 Switch pin
38 Ring groove
39 Shoulder of the sealing body
40 Outer lateral surface of the ball carrier
41 Outer lateral surface of the switch pin
42 End section of the switch pin
43 Restoring spring
44 Plunger
45 Snap ring
46 Ring step of the switch pin
47 Sliding body
48 Ring step of the sliding body
49 Sliding spring
50 Sliding section
51 Disk
52 Shoulder of the piston
53 Locking body
54 Collar
55 Locking section
56 Ring bead
57 Recess
58 End surface of the ball carrier
59 First end surface of the sleeve body
60 Second end surface of the sleeve body
61 End surface of the locking body
62 End surface of the sealing body
63 First end surface of the sliding body
64 Second end surface of the sliding body
65 End surface of the plunger
66 End surface of the switch pin
67 Connecting space
68 Pressure channel

The invention claimed is:

1. Switchable device for supplying pressure to at least one load of an internal combustion engine, comprising:

a cavity formed within a camshaft, a displacement element that is arranged in the cavity and that is displaceable between a first end position and a second end position, wherein the displacement element is provided with a pressure surface that at least partially borders, together with a wall of the cavity, a storage space that is connectable in a fluid-conducting manner to the load, and the storage space is connectable in a fluid-conducting manner to a pressure source, a force accumulator interacting with the displacement element, wherein the displacement element can be displaced through pressurization of the storage space against a force of the force accumulator from the first end position into the second end position, a locking mechanism for locking the displacement element in the second end position, a switch mechanism actuated by an actuator with a switch element that can be brought into at least first and second switch positions and interacts with the locking mechanism so that the locking of the displacement element in the first switch position is maintained and is released in the second switch position.

2. Device for supplying pressure according to claim 1, wherein the storage space is connectable in a fluid-conducting manner to the load and to the pressure source by at least one leakage prevention device for pressurized medium, and the leakage prevention device conducts flow in the presence of pressurization and blocks flow in the absence of pressurization.

3. Device for supplying pressure according to claim 2, further comprising the leakage prevention device is used as a limit for the storage space.

4. Device for supplying pressure according to claim 1, wherein:

a ball carrier that is connected rigidly to the camshaft and surrounds the switching element, the ball carrier has a plurality of openings in each of which a ball is held so that it can move in a radial direction and is supported in the radial direction by a support surface formed by the switching element, a locking element is connected rigidly to the displacement element and is provided with a locking section that is led into engagement with the balls for locking the displacement element in the second end position, the switching element can be displaced relative to the ball carrier against a force of a first restoring element by the actuator from the first switch position into the second switch position, and the support surface of the switch element is provided with at least one recess such that the balls can be held in the second switch position at least partially by the recess, so that the locking section is led out of engagement with the balls.

5. Device for supplying pressure according to claim 4, further comprising a sliding element that is displaceable by the displacement element against a force of a second restoring element, the sliding element is constructed so that it slides around the balls in the first end position of the displacement element and is released in the second end position.

6. Device for supplying pressure according to claim 4, wherein the ball carrier is connected rigidly to the sealing element.

7. Device for supplying pressure according to claim 1, further comprising a sealing element on which the force accumulator of the displacement element is supported.

8. Device for supplying pressure according to claim 1, wherein the force accumulator is constructed as a spring element.

9. Device for supplying pressure according to claim 1, wherein the pressure source is connectable in a fluid-conducting manner via at least one non-return valve that forms a block in a direction of the pressure source to the load and to the storage space.

10. Device for supplying pressure according to claim 1, wherein oil from a lubricating oil circuit is used as the pressurized medium.

11. Device for supplying pressure according to claim 1, wherein the load is a hydraulic camshaft adjuster.

12. Internal combustion engine with at least one switchable device for supplying pressure to a load according claim 1.

* * * * *